United States Patent [19]

Watanabe et al.

[11] 4,381,940

[45] May 3, 1983

[54] LOW ALLOY HEAT-RESISTING STEEL FOR HIGH TEMPERATURE USE

[75] Inventors: Juro Watanabe, Tokyo; Keizo Ohnishi; Toru Ishiguro, both of Muroran; Takatoshi Ogawa, Noboribetsu, all of Japan

[73] Assignee: The Japan Steel Works, Ltd., Japan

[21] Appl. No.: 182,830

[22] Filed: Aug. 29, 1980

[30] Foreign Application Priority Data

Nov. 15, 1979 [JP] Japan ..... 54-148218

[51] Int. Cl.[3] ..... C22C 38/06; C22C 38/22; C22C 38/28; C22C 38/32

[52] U.S. Cl. ..... 75/124; 75/126 C; 75/126 D; 75/126 E; 75/126 P; 75/128 F; 75/128 T; 75/128 V; 75/128 W

[58] Field of Search ..... 75/124, 126 C, 126 D, 75/126 E, 126 P, 128 F, 128 G, 128 Z, 128 T, 128 W, 128 V

[56] References Cited

U.S. PATENT DOCUMENTS 3,643,677 8/1969 Nakamura et al. ..... 75/124 BA
4,266,974 5/1981 Nitta et al. ..... 75/124 B

*Primary Examiner*—Michael L. Lewis
*Attorney, Agent, or Firm*—McGlew and Tuttle

[57] ABSTRACT

The present invention provides low alloy steels having high strength and toughness, excellent high temperature creep rupture strength and ductility and low sensitivity to temper embrittlement. The alloy steel is a low carbon, low silicon-type Cr-Mo-V low alloy steel, to which are added aluminum, titanium, niobium and Zirconium individually or in combination and further, a small amount of boron.

2 Claims, 2 Drawing Figures

LOW ALLOY HEAT-RESISTING STEEL FOR HIGH TEMPERATURE USE

BACK GROUND OF THE INVENTION

The present invention relates to low alloy heat-resisting steel for high temperature use, characterized in that it has high tensile strength, high creep rupture strength and high toughness, being excellent in creep rupture ductility and low temper embrittlement susceptibility, which is used as a base metal and weld metal.

Lately the operating conditions in fossile fue land nuclear power plants, petroleum refineries and petrochemical plants, tend to increasingly become more severe in service temperature and pressure. And furthermore, recent developments of coal gasifying and liquefying processes, which will prevail under the present situation of oil shortage, are foreseen to expedite the same tendency in the operational condition of steel materials.

From these situation, structural low alloy steels operating under the condition of high temperature and high pressure, especially materials used for large sized pressure vessels, are highly desired to have excellent properties such as in tensile strength, impact toughness, creep rupture strength and rupture ductility, and not to exhibit any material deterioration due to temper embrittlement during high temperature service.

Tensile strength, ductility and impact toughness of these structural materials are indispensable material properties for the prevention of unstable fracture during service or proof tests at periodic inspections.

Creep rupture strength and creep rupture ductility are also important properties for the prevention of inelastic deformation and creep cracking of structure under high temperature operations.

Further, high resistance to temper embrittlement is especially important material property, because the temper embrittlement phenomenon, which occurs at operating temperatures of 400° C. to 500° C., largely reduces the low temperature impact toughness of structural materials.

Now, conventional low alloy steels used for high temperature service such as 1%Cr-0.5%Mo steel, 1¼%Cr-0.5%Mo steel, 2¼%Cr-1%Mo steel and 3%Cr-1%Mo steel will be reviewed. These conventional low alloy steels are shown to have creep rupture strength insufficient to withstand severe conditions such as higher temperatures and pressures and involve problems in their structural integrity. Further, at the present trend of large sized pressure vessels, these conventional low alloy steels are believed to involve big problems in the fabricating technique and in the cost of pressure vessels having heavy wall sections.

One more point identified as a problem of the conventional steel is the creep embrittlement phenomenon occurring under prolonged service at high temperature, where the creep rupture ductility especially of the weld heat affected zone tends to be largely reduced and to generate easily grain boundary creep cracking. This phenomenon of creep embrittlement causes notch-weakening at the stress concentration site such as a nozzle corner in welded structures. Therefore, improvement of the resistance to creep embrittlement will be required to guarantee the integrity of welded structures.

BRIEF SUMMARY OF THE INVENTION

One object of the present invention is to provide a low alloy steel for high temperature use, which is made by adding Aluminum, Titanium and Niobium seperately or collectively, Vanadium and further Boron to low Si-Cr-Mo steel containing 1–3.5% Chromium and 0.5–1.5% Molybdenum by weight, said low alloy steel for high temperature use having high tensile strength, high impact toughness, high creep rupture strength, excellent creep rupture ductility and low susceptibility to temper embrittlement.

Another object of the present invention is to provide a steel having excellent hardenability for use in large sized and heavy walled structures of various high temperature and high pressure plants.

DETAILED DESCRIPTION OF THE INVENTION

Figure 1:
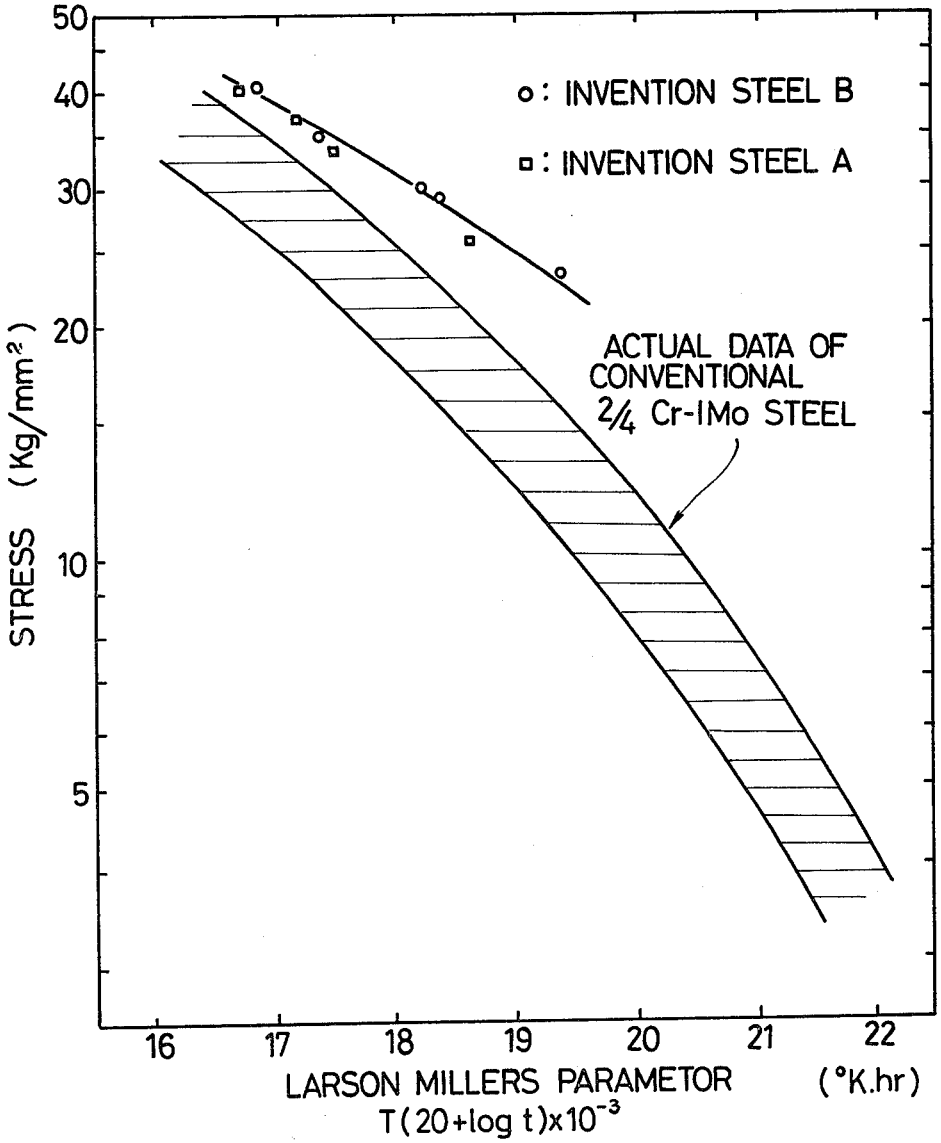
FIG. 1 illustrates the creep rupture strength of steel A and steel B of the invention in comparison with the actual result of a typical conventional heat-resisting low alloy steel, i.e. 2¼%Cr-1%Mo steel, the composition of the steel B being shown in Table 2a, with the creep rupture test data being plotted by mean of the Larson-Miller's parametric method.

As a result of various studies made by us, the inventors, to overcome the drawbacks of conventional steels as mentioned above, we discovered a low alloy heat-resisting steel useable for high temperature service, which has high tensile strength, high impact toughness, high creep rupture strength, excellent creep rupture ductility and very low susceptibility to temper embrittlement.

The composition of the steel according to the present invention is described hereunder. The chemical compositions of the steel are shown in weight percent throughout this specification.

A carbon content of 0.05% or more is required to increase the tensile strength and creep rupture strength, but on the other hand, the increased amount of carbon content reduces the weldability or increases the stress relief cracking susceptibility, and also reduces the creep rupture ductility as well as the impact toughness, and therefore the carbon content was limited to 0.25% maximum.

Silicon is used as a deoxidizing element in a refining process of the steel making, effective in improving strength and hardenability, and usually is 0.2% or more in conventional steel. However, Silicon, at the same time, acts to increase the susceptibility to temper embrittlement, and so it was limited to 0.10% or less because of the need of keeping a good impact toughness of the steel after prolonged exposure at the high temperature range where the temper embrittlement markedly occurs.

Manganese acts as a deoxidizing element in the same manner as Silicon, and also improves the hardenability of the steel, but on the other hand, it increases the susceptibility to temper embrittlement. Therefore, its content was limited to the range of 0.30%–0.80%.

Nickel improves the hardenability of steels and also their impact toughness, but acts to increase the temper embrittlement susceptibility and also to remarkably decrease the high temperature creep rupture strength. Therefore its content must be limited to 0.25% or less.

Chromium is the element necessary to improve oxidization resistance in steel in high temperature use, and also acts to improve hardenability and increase creep rupture strength by forming a stable carbide. For these reasons, the content of chromium should be 1.0% or more, but if it exceeds 3.5%, it reduces the amount of solid solution carbon and induces the growth of precipitated carbide, which causes the creep rupture strength to be lowered. Therefore, the most appropriate content of Chromium is in the range of 1.00–3.50%.

Molybdenum has the effect of solid solution hardening which increase the creep rupture strength, and combines with Carbon to form a stable carbide which also increases the creep rupture strength. For these reason, the content of Molybdenum should be 0.5% or more. However, its effect in increasing creep rupture strength saturates if its content exceeds 1.5%, and therefore considering also the high price of Molybdenum at present time, the content of Molydbenum is set to a range of 0.50%–1.50%.

Vanadium forms fine carbide with carbon and, remarkably increases the creep rupture stength of the steel. The content of vanadium for this purpose must be 0.05% or more. But, if its content exceeds 0.3%&, it deteriorates the weldability, especially increasing the stress relief cracking susceptibility, and also lowers the impact toughness and the creep rupture ductility of the steel. Therefore, a content in the range of 0.05–0.30% is most effective.

Boron precipitates at the grain boundaries, prevents the formation of the creep void, and acts to suppress creep embrittlement. Boron also has the important effect of increasing the hardenability of this low alloy steel. To achieve these effect of Boron, the content of 0.001% or more is necessary. But if it exceeds 0.010%, hot workability of this steel is remarkably lowered. So, the content of Boron must be controlled within the range of 0.001%–0.010%.

Aluminum, Titanium, Niobium and Zirconium are the elements to be added separately or in combination in order to stabilize Nitrogen and Oxygen. Addition of these elements inhibits Boron to combine with Nitrogen and Oxygen and prevents the loss of the intended effect of Boron. Aluminum, Titanium, Niobium and Zirconium also act to form their fine Nitride, the refining grain size resulting in the contribution to the improvement of the impact toughness and creep rupture ductility of the steel. However, a separate addition of these element exceeding 0.05% or a combined addition of them exceeding 0.10% in total weight percent will cause formations of harmful non-metallic inclusions such as of Nitride and Oxide. Therefore these elements were limited to the range of 0.015–0.05% for individual additions and to 0.10% or less for combined additions, respectively.

Now, preferred embodiments according to the invention will be described hereunder.

Table 1a tabulates the chemical composition of steel A of the invention in comparison with that of the conventional 2¼%Cr-1%Mo steel, while Table 1b tabulates the results of the tensile test at room and high temperature. It will be understood that the steel A has a much higher yield strength and tensile strength than the conventional steel.

FIG. 1 shows the creep rupture strength of steel A and B of the invention in comparison with the scatter band of actual data obtained in a conventional 2¼%Cr-1%Mo steel, the test data being plotted by mean of the Larson-Miller's Parametric method. The chemical composition of steel B is shown in Table 2a. It will be appreciated that steels A and B of the invention have a much higher creep rupture strength than the upper limit of actual data of the conventional 2¼% Cr-1% Mo steel.

These yield strength, tensile strength and creep rupture strength values at the high temperature are very important material properties. These improvements in the material properties as shown in Table 1b and FIG. 1 not only are key factors in assuring the integrity of steel structures, but also permit the setting of allowable design stresses higher than that of the conventional steel, making it possible to build lighter and thinner structures resulting in large cost reductions.

Table 2b shows the result of creep rupture test data of steel B of the invention in the use as the welded structural member, wherein the coarse-grained portion of the weld heat-affected zone was reproduced by a weld thermal cycle simulation device, the comparison being made with similar results of the conventional 1Cr-0.5Mo steel, 1¼%Cr-1%Mo steel and 2¼%Cr-1%Mo steel. The creep rupture strength of the coarse-grained portion of weld heat affected zone is higher in the steel B of the invention than in the conventional steel, and the creep rupture ductility of the invention steel B is superion to that of the conventional steel, with no creep embrittlement phenomenon being observed.

Table 3a tabulates V-notch charpy impact test results of the invention steels C, D and E, as heat treated and also after the embrittlement heat treatment namely step cooling method. As shown in Table 3a, impurity elements P and Sn are intentionally added to these steel samples for the purpose of evaluating the susceptibility of the invention steel to temper embrittlement. The fracture appearance transition temperature (FATT) does not show much difference between the heat treated and after embrittlement heat treatment in the invention steel, demonstrating their low susceptibility to temper embrittlement compared with the conventional steel.

Figure 2:
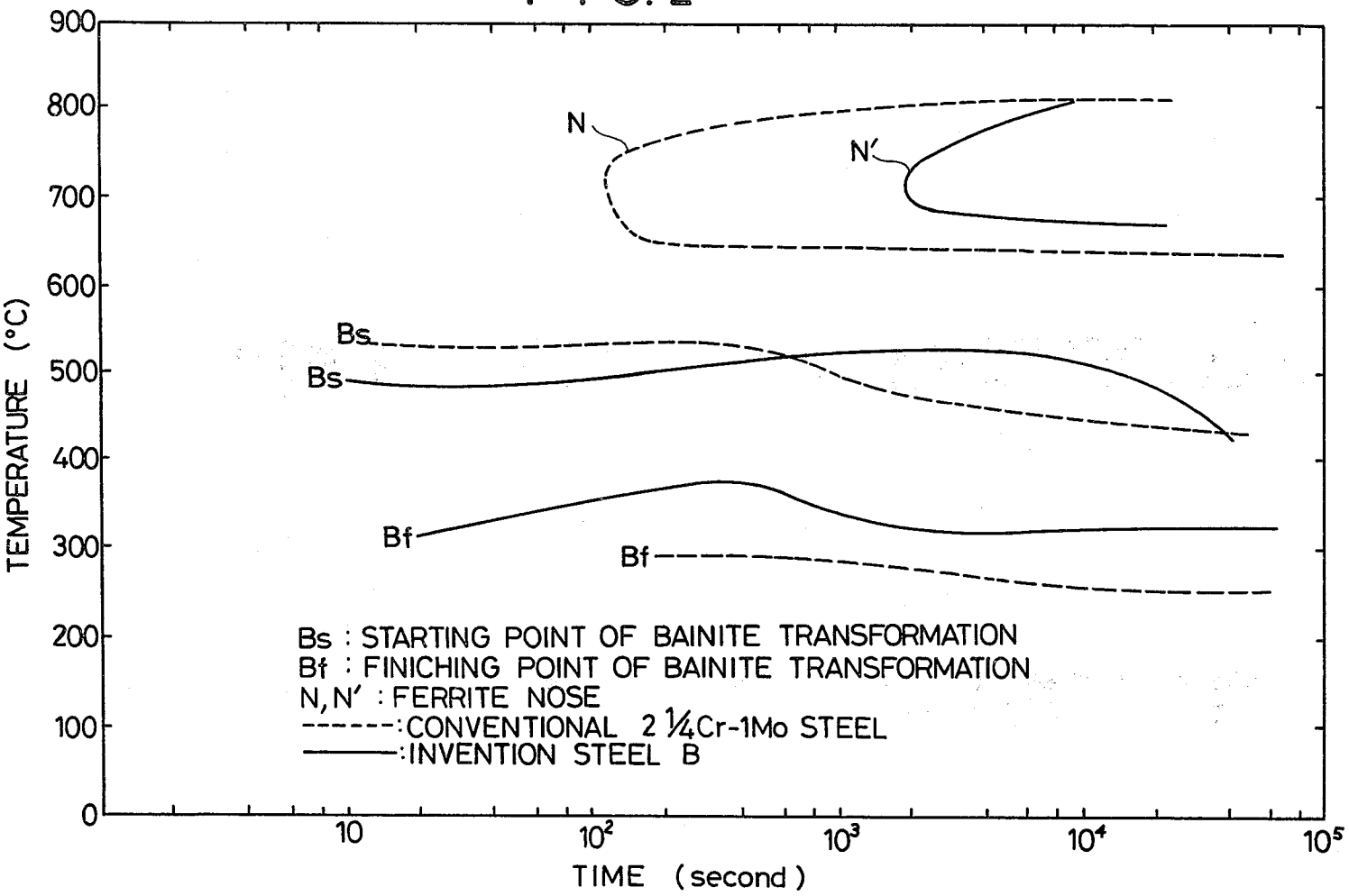
FIG. 2 illustrates the comparison of the continuous cooling transformation diagram between a conventional 2¼%Cr-1%Mo steel and the steel B in the invention, which were measured to assess the hardenability of the steel B.

FIG. 2 shows the comparison of the continuous cooling transformation diagram of the invention steel B with those of the conventional 2¼%Cr-1%Mo steel to evaluate the hardenability of the steel B. The ferrite nose of the continuous cooling transformation diagram of the steel B is situated at a position of a longer time than that of the conventional steel, showing the much improved hardenability of the steel B compared to the conventional steel. Those results show that the steel according to the invention has the homogeneous bainitic structure and uniform mechanical properties through the thick of its heavy walled plate.

As clearly understood from the above description, the steel according to the invention is a low alloy heat resisting steel for high temperature use which has higher tensile strength and higher creep rupture strength at high temperature than those of conventional low alloy steels. Further, it has higher impact toughness and lower susceptibility to temper embrittlement and creep embrittlement in the use at high temperature and is a stable material free from property deterioration during use.

The steel according to the invention is quite suitable as a high performance material for use in large and thick structures such as are found in various plants operating under high temperatures and pressures.

TABLE 1a

Tension rupture properties of the invention steel

Chemical composition of the invention steel A and the conventional steel

| | wt % | | | | | | | | | | | |
|---|---|---|---|---|---|---|---|---|---|---|---|---|
| | C | Si | Mn | P | S | Ni | Cr | Mo | V | Al | Ti | B |
| Invention steel A | 0.10 | 0.02 | 0.51 | 0.005 | 0.005 | 0.10 | 2.20 | 0.94 | 0.21 | 0.011 | 0.022 | 0.0023 |
| Conventional Steel | 0.14 | 0.24 | 0.51 | 0.008 | 0.007 | 0.01 | 2.32 | 0.95 | — | 0.004 | — | — |

TABLE 1b

Tensile test result of the invention steel A and the conventional steel

| | Test temperature °C. | 0.2% yield strength kg/mm² | tensile strength kg/mm² | elongation % | reduction of area % |
|---|---|---|---|---|---|
| Invention steel A | R.T. | 53.5 | 63.6 | 26.2 | 80.0 |
| | 250 | 46.7 | 55.7 | 23.1 | 79.9 |
| | 350 | 46.8 | 54.3 | 22.1 | 77.8 |
| | 450 | 44.4 | 51.4 | 20.9 | 79.4 |
| | 550 | 44.1 | 50.2 | 19.6 | 79.6 |
| Conventional steel | R.T. | 45.5 | 60.3 | 25.3 | 80.2 |
| | 250 | 42.2 | 53.5 | 22.8 | 78.0 |
| | 350 | 40.5 | 50.9 | 19.3 | 77.0 |
| | 450 | 32.2 | 41.4 | 23.0 | 80.1 |
| | 550 | 28.8 | 38.5 | 24.8 | 79.5 |

TABLE 2a

Chemical composition

| | wt % | | | | | | | | | | | |
|---|---|---|---|---|---|---|---|---|---|---|---|---|
| | C | Si | Mn | P | S | Ni | Cr | Mo | V | Al | Ti | B |
| invention steel B | 0.10 | 0.02 | 0.51 | 0.005 | 0.005 | 0.012 | 2.20 | 0.94 | 0.30 | 0.010 | 0.022 | 0.0023 |
| conventional steel 2¼Cr-1Mo | 0.14 | 0.24 | 0.51 | 0.008 | 0.007 | 0.01 | 2.32 | 0.95 | — | 0.004 | — | — |

TABLE 2b

The result of Creep rupture test at 500° C. of coarsened grain portion of welding heat-affected zone in the invention steel

| | stress kg/mm² | rupture time hr | rupture elongation % | rupture strength % |
|---|---|---|---|---|
| invention steel B | 32.0 | 1973.1 | 22.3 | 82.8 |
| Conventional steel | | | | |
| 1% Cr-0.5% Mo steel | 20.0 | 1852.1 | 6.2 | 9.5 |
| 1¼% Cr-0.5% Mo steel | 20.0 | 2352 | 5.3 | 7.6 |

TABLE 2b-continued

The result of Creep rupture test at 500° C. of coarsened grain portion of welding heat-affected zone in the invention steel

| | stress kg/mm² | rupture time hr | rupture elongation % | rupture strength % |
|---|---|---|---|---|
| 2¼% Cr-1% Mo steel | 21.0 | 1952.0 | 20.2 | 52.1 |

TABLE 3

Sensitivity to temper brittleness of the invention steel vs. impurity elements (a) chemical composition

| | C | Si | Mn | P | S | Ni | Cr | Mo | V | Al | Ti | B | Sn |
|---|---|---|---|---|---|---|---|---|---|---|---|---|---|
| Invention steel C | 0.10 | 0.02 | 0.54 | 0.009 | 0.007 | 0.11 | 2.30 | 0.97 | 0.21 | 0.010 | 0.022 | 0.0022 | 0.005 |
| Invention steel D | 0.10 | 0.02 | 0.53 | 0.018 | 0.007 | 0.10 | 2.24 | 1.00 | 0.20 | 0.009 | 0.021 | 0.0020 | 0.018 |
| Invention steel E | 0.10 | 0.02 | 0.51 | 0.027 | 0.007 | 0.10 | 2.15 | 0.94 | 0.19 | 0.009 | 0.023 | 0.0024 | 0.035 |
| conventional steel | 0.14 | 0.26 | 0.61 | 0.011 | 0.009 | 0.11 | 2.32 | 1.02 | — | 0.009 | — | — | 0.012 |

(b) Result of Charpy impact tests

| | as heat treated: absorbed energy (°C.) | as heat treated: FATT | after brittleness treatment: absorbed energy (°C.) | after brittleness treatment: FATT |
|---|---|---|---|---|
| Invention steel C | 29.5 kg-m | −17° C. | 30.2 kg-m | −21° C. |
| Invention steel D | 24.7 kg-m | +2° C. | 24.0 kg-m | +6° C. |
| Invention steel E | 22.8 kg-m | +3° C. | 21.5 kg-m | +11° C. |
| conventional steel | 23.5 kg-m | −28° C. | 7.9 kg-m | +41° C. |

FATT: Transition temperature of impact rupture surface in Chalpy's V notch test

What is claimed is:

1. Low alloy, heat-resistant, high temperature steel comprising by weight 0.08–0.15% carbon, up to 0.05% silicon, 0.40–0.60% manganese, up to 0.15% nickel, 2.00–3.00 chromium, 0.80–1.20% molybdenum, 0.15–0.25% vanadium, 0.020–0.030% titanium, and 0.0015–0.0025% boron, balance iron and incidental impurities.

2. Low alloy, heat-resistant, high-temperature steel comprising by weight 0.08–0.15% carbon, up to 0.05% silicon, 0.40–0.60% manganese, up to 0.15% nickel, 2.00–3.00 chromium, 0.80–1.20% molybdenum, 0.15–0.25% vanadium, 0.020–0.030% aluminum, and 0.0015–0.0025% boron, balance iron and incidental impurities.

* * * * *